US011621117B2

(12) United States Patent
Morinaga

(10) Patent No.: US 11,621,117 B2
(45) Date of Patent: Apr. 4, 2023

(54) COIL COMPONENT AND MANUFACTURING METHOD THEREFOR

(71) Applicant: Murata Manufacturing Co., Ltd., Kyoto-fu (JP)

(72) Inventor: Tetsuya Morinaga, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 359 days.

(21) Appl. No.: 16/903,310

(22) Filed: Jun. 16, 2020

(65) Prior Publication Data

US 2020/0312529 A1 Oct. 1, 2020

Related U.S. Application Data

(63) Continuation of application No. PCT/JP2018/039317, filed on Oct. 23, 2018.

(30) Foreign Application Priority Data

Mar. 5, 2018 (JP) ..... JP2018-038775

(51) Int. Cl.
*H01F 27/28* (2006.01)
*H01F 27/255* (2006.01)
(Continued)

(52) U.S. Cl.
CPC ..... *H01F 27/2823* (2013.01); *H01F 27/255* (2013.01); *H01F 27/29* (2013.01);
(Continued)

(58) Field of Classification Search
CPC .... H01F 17/045; H01F 27/2823; H01F 41/06; H01F 5/00; H01F 27/28; H01F 17/062;
(Continued)

(56) References Cited

U.S. PATENT DOCUMENTS

2012/0146756 A1 6/2012 Roellgen et al.
2016/0172099 A1 6/2016 Panat et al.
2017/0125165 A1 5/2017 Prest

FOREIGN PATENT DOCUMENTS

CN 102473505 A 5/2012
CN 105632893 A 6/2016
(Continued)

OTHER PUBLICATIONS

An Office Action mailed by China National Intellectual Property Administration dated Jul. 13, 2021 which corresponds to Chinese Patent Application No. 201880089447.7 and is related to U.S. Appl. No. 16/903,310 with English language translation.
(Continued)

*Primary Examiner* — Thiem D Phan
(74) *Attorney, Agent, or Firm* — Studebaker & Brackett PC

(57) ABSTRACT

A wire wound-type coil component with an integrated structure does not have a bonding portion where there is concern about reliability with respect to a spiral conductive wire, a terminal electrode, and an annular core. A coil component includes a core with an integrated structure, at least part of which is a winding core portion, which has an annular shape having a through-hole, and which is made of a non-conductive material; and a coil conductor with an integrated structure, which has a spiral conductive wire arranged to spirally extend around the winding core portion and first and second terminal electrodes formed at both end portions of the spiral conductive wire, respectively. The coil component is manufactured through three-dimensionally shaping the core, the coil conductor, and a shape holding member for holding a shape of a wall surface of the core defining the through-hole, by using a 3D printer.

16 Claims, 6 Drawing Sheets

(51) Int. Cl.
*H01F 27/29* (2006.01)
*H01F 41/02* (2006.01)
*H01F 41/06* (2016.01)

(52) U.S. Cl.
CPC ..... *H01F 41/0206* (2013.01); *H01F 41/06* (2013.01); *Y10T 29/53178* (2015.01)

(58) Field of Classification Search
CPC ..... H01F 41/08; Y10T 29/49073; Y10T 29/53178
USPC ..... 29/740, 604, 606, 729, 741, 795
See application file for complete search history.

(56) References Cited

FOREIGN PATENT DOCUMENTS

| | | | | |
|---|---|---|---|---|
| JP | H02-110908 | A | | 4/1990 |
| JP | H06-310334 | A | | 11/1994 |
| JP | H07-220948 | A | | 8/1995 |
| JP | H08-203762 | A | | 8/1996 |
| JP | 2001-068364 | A | | 3/2001 |
| JP | 2005-322766 | A | | 11/2005 |
| JP | 2006-351860 | A | | 12/2006 |
| JP | 2007-081051 | A | | 3/2007 |
| JP | 2013-175505 | A | | 9/2013 |
| JP | 2015-216319 | A | | 12/2015 |
| JP | 2016-025150 | A | | 2/2016 |
| JP | 2016025150 | A | * | 2/2016 |
| JP | 2016-184732 | A | | 10/2016 |
| JP | 2017-085044 | A | | 5/2017 |
| JP | 2017-112344 | A | | 6/2017 |
| JP | 2017-131051 | A | | 7/2017 |
| JP | 2017-150022 | A | | 8/2017 |
| WO | 2016/036854 | A1 | | 3/2016 |
| WO | 2017/208428 | A1 | | 12/2017 |

OTHER PUBLICATIONS

International Search Report issued in PCT/JP2018/039317; dated Jan. 29, 2019.
Written Opinion issued in PCT/JP2018/039317; dated Jan. 29, 2019.
An Office Action; "Notice of Reasons for Refusal," mailed by the Japanese Patent Office dated Apr. 27, 2021, which corresponds to Japanese Patent Application No. 2020-504770 and is related to U.S. Appl. No. 16/903,310 with English language translation.

* cited by examiner

COIL COMPONENT AND MANUFACTURING METHOD THEREFOR

CROSS-REFERENCE TO RELATED APPLICATIONS

This application claims benefit of priority to International Patent Application No. PCT/JP2018/039317, filed Oct. 23, 2018, and to Japanese Patent Application No. 2018-038775, filed Mar. 5, 2018, the entire contents of each are incorporated herein by reference.

BACKGROUND

Technical Field

The present disclosure relates to a coil component and a manufacturing method therefor, and particularly relates to a coil component including a coil conductor wound around a core and a manufacturing method therefor.

Background Art

In a toroidal coil having a structure in which a conductive wire is spirally wound around an annular core made of a magnetic body, for example, the annular core and the spiral conductive wire form an interlinkage structure. In the toroidal coil, a magnetic flux passes through the core while being confined in the annular core, whereby a closed magnetic path is formed. Therefore, the magnetic flux in the core is not affected by change in the state outside the core, and almost no magnetic flux is present outside the core.

Since magnetoresistance of the magnetic path in the toroidal coil as described above is small, when compared in the same number of turns of the conductive wire, the same core cross-sectional area, and the same magnetic path length, a larger amount of magnetic flux can be generated and a larger inductance value can be obtained as compared with an air-core type or open magnetic path type coil.

On the other hand, in order to manufacture the toroidal coil, it is necessary to perform a step of, while using at least part of the annular core as a winding core portion, spirally winding a conductive wire therearound. At this time, since the winding core portion is provided by at least part of the annular core, it is necessary to repeat passing the conductive wire through a through-hole of the core every one turn. However, it is difficult to mechanize this step, and it is usually necessary to rely on complicated manual operations.

As a technique to enable to avoid complicated manual operations as described above, for example, there are the technique disclosed in Japanese Unexamined Patent Application Publication No. 2001-68364, or the technique disclosed in Japanese Unexamined Patent Application Publication No. 8-203762.

Japanese Unexamined Patent Application Publication No. 2001-68364 discloses a method for manufacturing a toroidal coil by preparing an annular core being divided, inserting the divided core, while annularly bending a cylindrical coil having a form in which a conductive wire is spirally wound in advance, into an air-core portion of the cylindrical coil, and then bonding the divided surfaces of the cores to each other with an adhesive.

Japanese Unexamined Patent Application Publication No. 8-203762 discloses a manufacturing method for a toroidal coil which is a method for obtaining a spiral conductive wire by alternately connecting a plurality of conductors each having an inverted U-shape and a plurality of conductor films on a wiring board, in which an annular core is arranged in a state of being aligned with the conductor films on the wiring board, and then in order to obtain the spiral conductive wire, while arranging the plurality of conductors each having the inverted U-shape so as to straddle over the core, the plurality of conductors each having the inverted U-shape and the plurality of conductor films on the wiring board are respectively bonded by solder.

SUMMARY

However, both the technique disclosed in Japanese Unexamined Patent Application Publication No. 2001-68364 and the technique disclosed in Japanese Unexamined Patent Application Publication No. 8-203762 described above include problems to be solved.

First, the technique disclosed in Japanese Unexamined Patent Application Publication No. 2001-68364 and the technique disclosed in Japanese Unexamined Patent Application Publication No. 8-203762 both have a problem in that the number of steps for manufacturing the toroidal coil is larger than that of the manual operation for causing a conductive wire to pass through a through-hole of the core every one turn. In the technique disclosed in Japanese Unexamined Patent Application Publication No. 2001-68364, it is necessary to add at least the step for making the divided surfaces of the core adhere to each other. In the technique disclosed in Japanese Unexamined Patent Application Publication No. 8-203762, it is necessary to add at least the step for soldering the plurality of conductors each having the inverted U-shape and the plurality of conductor films on the wiring board, respectively.

In addition, in both the technique disclosed in Japanese Unexamined Patent Application Publication No. 2001-68364 and the technique disclosed in Japanese Unexamined Patent Application Publication No. 8-203762, a bonding step such as adhering or soldering is inevitable to obtain the toroidal coil. Therefore, there is concern about reliability at the bonding portion as compared with an integrated body. In particular, in the technique disclosed in Japanese Unexamined Patent Application Publication No. 2001-68364, there is a serious problem in that, when the core itself which is a main portion of the coil component breaks, a component itself is destroyed. Furthermore, even if the core itself does not break, there is a problem that inductance acquisition efficiency is lowered due to leakage of magnetic flux at the bonding portion of the core. On the other hand, in the technique disclosed in Japanese Unexamined Patent Application Publication No. 8-203762, a fatal problem such as disconnection in the spiral conductive wire constituted of the plurality of conductors each having the inverted U-shape and the plurality of conductor films on the wiring board cannot be ignored.

Furthermore, in general, in a surface-mounting type coil component, terminal electrodes are provided along a surface of the core, and end portions of the spiral conductive wire are respectively bonded to the terminal electrodes. In this case as well, since the spiral conductive wire and the terminal electrodes are separate bodies from each other, there is concern about reliability at the bonding portion.

Furthermore, miniaturization of a coil component has advanced, and market demands extend, for example, up to 1 mm or less in longitudinal dimension. However, at present, in the toroidal coil having the dimension as described above, although it is necessary to perform wire-winding to the annular core, it may be said that it is almost impossible to perform the wire-winding to the annular core. The wire-winding by manual operation is surely impossible, and even if an automatic wire-winding machine is used, such a small automatic wire-winding machine is not present. This is also due to the limitation of miniaturization in mechanical aspects, but the main cause is insufficient strength (lack of stiffness) of the conductive wire to be wound.

Accordingly, the present disclosure provides a wire wound-type coil component which does not have a bonding portion where there is concern about reliability even with respect to an electrical element such as a spiral conductive wire and a terminal electrode, and even with respect to an annular core.

Another object of the present disclosure is to provide a method for making it possible to manufacture a coil component with ease, which does not have a bonding portion where there is concern about reliability, and which can be reduced to a size such as, for example, 1 mm or less in longitudinal dimension.

The present disclosure is directed first to a wire wound-type coil component including an annular core.

A coil component according to the present disclosure includes a core with an integrated structure, at least part of which is a winding core portion, which has an annular shape having a through-hole, and which is made of a non-conductive material; and a coil conductor with an integrated structure, which has a spiral conductive wire arranged so as to spirally extend around the winding core portion and first and second terminal electrodes formed at both end portions of the spiral conductive wire, respectively.

According to the present disclosure, since the core and the coil conductor having the spiral conductive wire and the terminal electrodes each have an integrated structure while having an interlinkage structure, a bonding portion where there is concern about deterioration in characteristics and reliability is not present.

Preferably, the core is made of a magnetic body, and forms a completely closed magnetic path. According to this configuration, it is possible to obtain a high inductance value in the coil component.

In the present disclosure, preferably, the core includes, in addition to the winding core portion, a drum-shaped portion having first and second flange portions respectively provided at a first end and a second end of the winding core portion located on opposite sides to each other, and a plate-shaped portion formed integrally with the drum-shaped portion and spanning between the first and second flange portions in a state of facing the winding core portion while forming the through-hole. Additionally, the spiral conductive wire is integrated with the winding core portion, and the first and second terminal electrodes are integrated with the first and second flange portions, respectively. According to this configuration, the coil component can be made to have a form suitable for surface mounting.

In the preferred embodiment, more preferably, a shape holding member made of an electrically insulating material, with which at least a space between the winding core portion and the plate-shaped portion is filled, is further included, and a portion of the spiral conductive wire located at least between the winding core portion and the plate-shaped portion is embedded in the shape holding member. In this configuration, the shape holding member plays a function to hold the shape of a wall surface defining the through-hole in the core. Accordingly, since the space between the winding core portion and the plate-shaped portion is filled with the shape holding member, the strength of the coil component can be increased.

It is preferable that the shape holding member described above be made of glass. Glass is relatively inexpensive and the shape holding member made of glass does not adversely affect the electrical characteristics of the coil component.

Furthermore, the shape holding member may be provided so as to cover the spiral conductive wire and the winding core portion, and part of each of the first and second terminal electrodes. According to this configuration, since the shape holding member covers the main portion of the coil component including the spiral conductive wire, the environmental resistance of the coil component can be improved.

In the present disclosure, it is preferable that the spiral conductive wire be circular in cross section. According to this configuration, stray capacitance generated between adjacent turns of the spiral conductive wire can be reduced.

In the present disclosure, it is preferable that each of the first and second terminal electrodes have a shape with which each of the first and second terminal electrodes cannot pass through the through-hole of the core. According to this configuration, the reliability of electrical connection and mechanical fixing of the coil component to the mounting substrate in the mounting state is enhanced. This preferred configuration is a characteristic configuration which can be obtained for the first time by employing a manufacturing method described below.

The present disclosure is also directed to a method for manufacturing the coil component described above, that is a coil component which includes a core with an integrated structure, at least part of which is a winding core portion, which has an annular shape having a through-hole, and which is made of a non-conductive material; and a coil conductor with an integrated structure, which has a spiral conductive wire arranged so as to spirally extend around the winding core portion and first and second terminal electrodes formed at both end portions of the spiral conductive wire, respectively.

The manufacturing method for the coil component according to the present disclosure includes a step of three-dimensionally shaping the core, the coil conductor, and a shape holding member for holding a shape of a wall surface of the core defining the through-hole, by using a 3D printer. By the three-dimensionally shaping using the 3D printer, it is possible to integrally shape the core and the coil conductor, and more specifically, the winding core portion and the spiral conductive wire of the interlinkage structure. Furthermore, the shape holding member makes it possible to three-dimensionally shaping the core and the coil conductor while holding the shape of the through-hole.

In the step of three-dimensionally shaping described above, preferably, an ink-jet discharge type 3D printer is used as the 3D printer, and a step of shaping the core with a non-conductive material powder containing solution, a step of shaping the coil conductor with a conductive metal powder containing solution, and a step of shaping the shape holding member with an electrically insulating material powder containing solution are performed. Additionally, the manufacturing method further includes a step of firing the core, the coil conductor, and the shape holding member shaped by the 3D printer.

Instead of the preferred embodiment described above, in the step of three-dimensionally shaping, an ink-jet discharge type 3D printer may be used as the 3D printer, and a step of shaping the core with a non-conductive material powder containing solution, a step of shaping the coil conductor with a conductive metal powder containing solution, and a step of shaping the shape holding member with a resin containing solution may be performed. Additionally, the manufacturing method further includes a step of firing the core, the coil conductor, and the shape holding member shaped by the 3D printer, and in the step of firing, the shape holding member may be burned off.

In each of the preferred embodiments described above, more preferably, a magnetic powder containing solution is used as the non-conductive material powder containing solution, and a copper powder containing solution or a silver powder containing solution is used as the conductive metal powder containing solution, and a glass powder containing solution with a low dielectric constant, an alumina powder containing solution, or a zirconia powder containing solution is used as the electrically insulating material powder containing solution.

As a coil component according to the present disclosure, since an annular core and a coil conductor having a spiral conductive wire and terminal electrodes each have an integrated structure, a bonding portion where there is concern about reliability is not present. Accordingly, it is possible to obtain a coil component electrically and mechanically high in reliability.

According to a manufacturing method for a coil component according to the present disclosure, a coil component in which an annular core and a coil conductor having a spiral conductive wire and terminal electrodes each have an integrated structure while having an interlinkage structure is manufactured through a step of three-dimensionally shaping using a 3D printer. Accordingly, it is possible to manufacture a coil component with ease, which does not have a bonding portion where there is concern about reliability, and which is reduced to a size such as, for example, 1 mm or less in longitudinal dimension.

DETAILED DESCRIPTION

Figure 1:
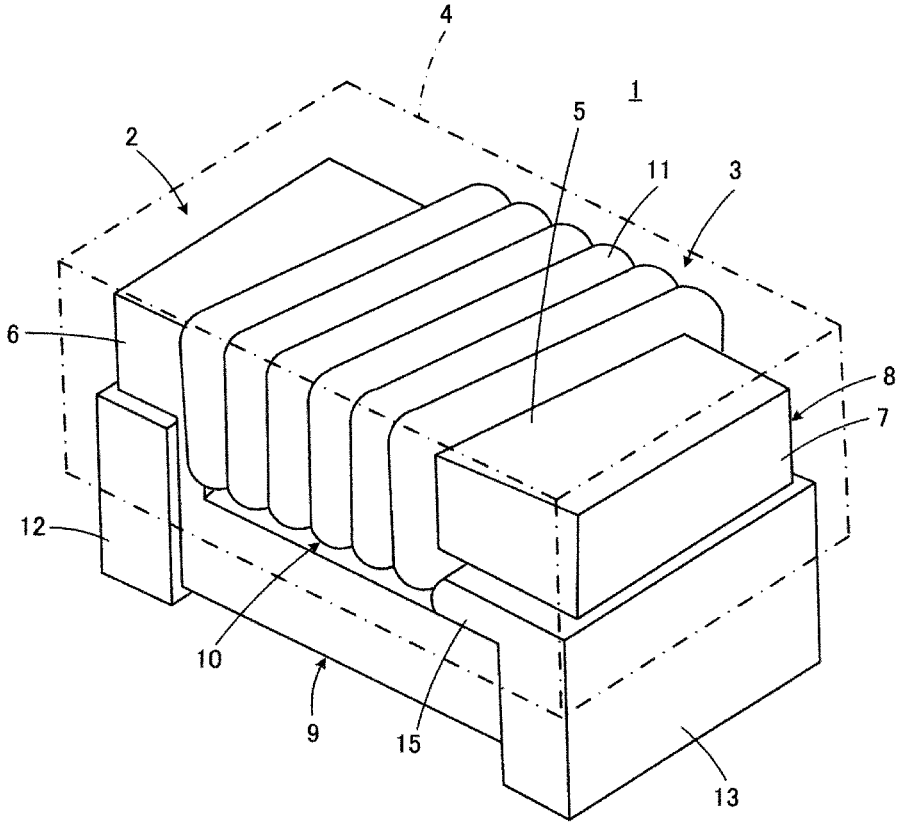
FIG. 1 is a perspective view illustrating an outer appearance of a coil component according to an embodiment of the present disclosure.

Referring to FIG. 1 to FIG. 4, a structure of a coil component 1 according to an embodiment of the present disclosure will be described. The illustrated coil component 1 constitutes, for example, a single coil.

The coil component 1 includes a core 2, a coil conductor 3, and a shape holding member 4. Note that in FIG. 1 to FIG. 4, the shape holding member 4 is indicated by the dot-dash line as a transparent member.

The core 2 is constituted of a non-conductive material, but is preferably constituted of a magnetic body such as ferrite or a metal magnetic body. However, the core 2 may be constituted of a non-magnetic body such as alumina. The core 2 includes a drum-shaped portion 8 having a winding core portion 5 having a rectangular cross section, and first and second flange portions 6 and 7 respectively provided at a first end and a second end of the winding core portion 5 located on the opposite sides to each other, and includes a plate-shaped portion 9 spanning between the first and second flange portions 6 and 7. The plate-shaped portion 9 faces the winding core portion 5.

The core 2 forms a completely closed magnetic path when being constituted of a magnetic body, and is an integrated structure. That is, the drum-shaped portion 8 and the plate-shaped portion 9 are integrated. The core 2 forms a through-hole 10 between the winding core portion 5 and the plate-shaped portion 9 facing each other, and has an annular shape as a whole.

The coil conductor 3 includes a spiral conductive wire 11 arranged so as to spirally extend around the winding core portion 5, and first and second terminal electrodes 12 and 13 formed, respectively, at both end portions of the spiral conductive wire 11. More specifically, the first and second terminal electrodes 12 and 13 form connection pieces 14 and 15 protruding into the through-hole 10, respectively, and both the end portions of the spiral conductive wire 11 are connected to the connection pieces 14 and 15, respectively. The coil conductor 3 is an integrated structure. Accordingly, the spiral conductive wire 11 and the first and second terminal electrodes 12 and 13 are integrated.

Figure 8:
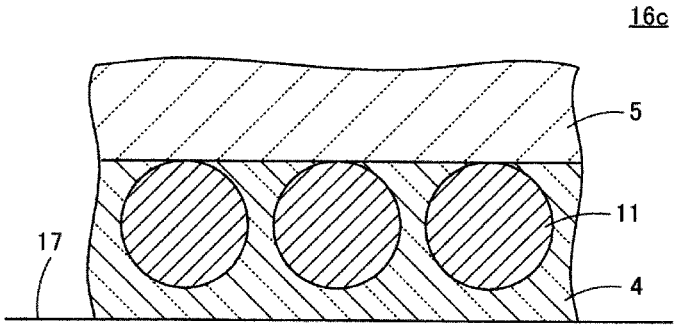
FIG. 8 is a cross-sectional view illustrating part of the shaped object 16*c* illustrated in FIG. 7, in an enlarged manner.

The spiral conductive wire 11 is preferably circular in cross section (see FIG. 8). According to this configuration, stray capacitance generated between adjacent turns of the spiral conductive wire 11 can be reduced. Furthermore, in order to improve reliability of electrical connection and mechanical fixing to a mounting substrate in a mounting state of the coil component 1, the first and second terminal electrodes 12 and 13 are each required to have a predetermined dimension or more. In this embodiment, each of the first and second terminal electrodes 12 and 13 has a shape with which each terminal cannot pass through the through-hole 10 of the core 2, for example, each of the first and second terminal electrodes 12 and 13 has a dimension larger than that of the through-hole 10. This configuration is a characteristic configuration which can be obtained for the first time by employing a manufacturing method which will be described later.

The shape holding member 4 is a member for holding the shape of a wall surface of the core 2 defining the through-hole 10, and at least a space between the winding core portion 5 and the plate-shaped portion 9 is filled therewith. Accordingly, a portion of the spiral conductive wire 11 located at least between the winding core portion 5 and the plate-shaped portion 9 is embedded in the shape holding member 4. As described above, when the space between the winding core portion 5 and the plate-shaped portion 9 is filled with the shape holding member 4, the strength of the coil component 1 can be increased. Note that the shape holding member 4 has an important function of enabling three-dimensional shaping by using a 3D printer, which is performed in a manufacturing method which will be described later.

The shape holding member 4 is made of an electrically insulating material such as glass, alumina, zirconia, or the like. Among these materials, glass is preferably used for forming the shape holding member 4. This is because glass is relatively inexpensive and the shape holding member 4 made of glass does not adversely affect the electrical characteristics of the coil component 1.

In this embodiment, the shape holding member 4 is provided so as to cover the spiral conductive wire 11 and the winding core portion 5, and part of each of the first and second terminal electrodes 12 and 13. According to this configuration, since the shape holding member 4 covers the main portion of the coil component 1 including the spiral conductive wire 11, the environmental resistance of the coil component 1 can be improved.

Next, an advantageous manufacturing method for the coil component 1 will be described with reference to FIG. 5 to FIG. 12.

The manufacturing method described here is characterized in that the core 2, the coil conductor 3, and the shape holding member 4 are three-dimensionally shaped by using a 3D printer. By three-dimensionally shaping using a 3D printer, the core 2 and the coil conductor 3 of the interlinkage structure can be integrally shaped.

Figure 2:
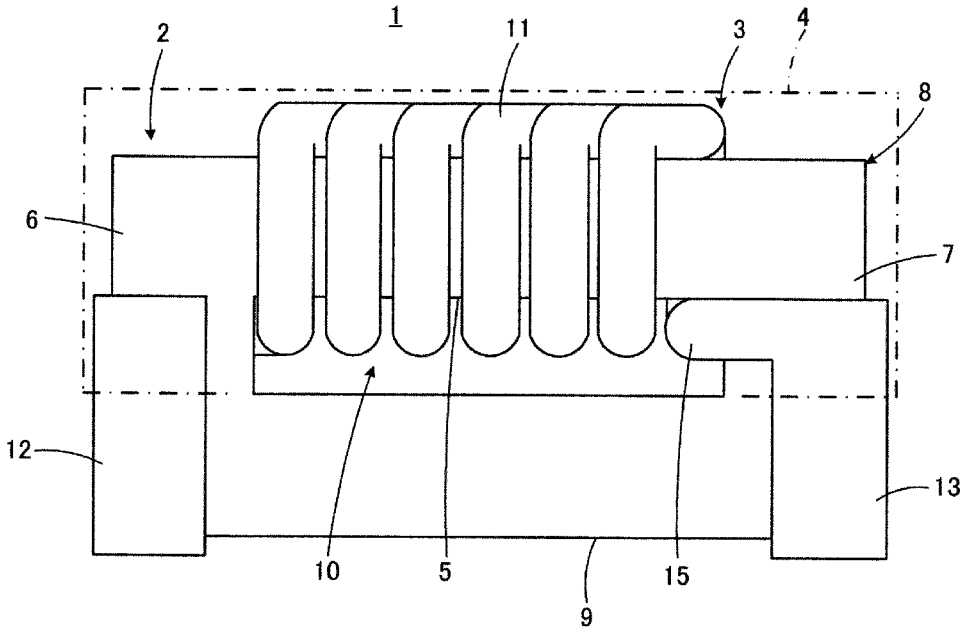
FIG. 2 is a front view of the coil component illustrated in FIG. 1.
Figure 3:
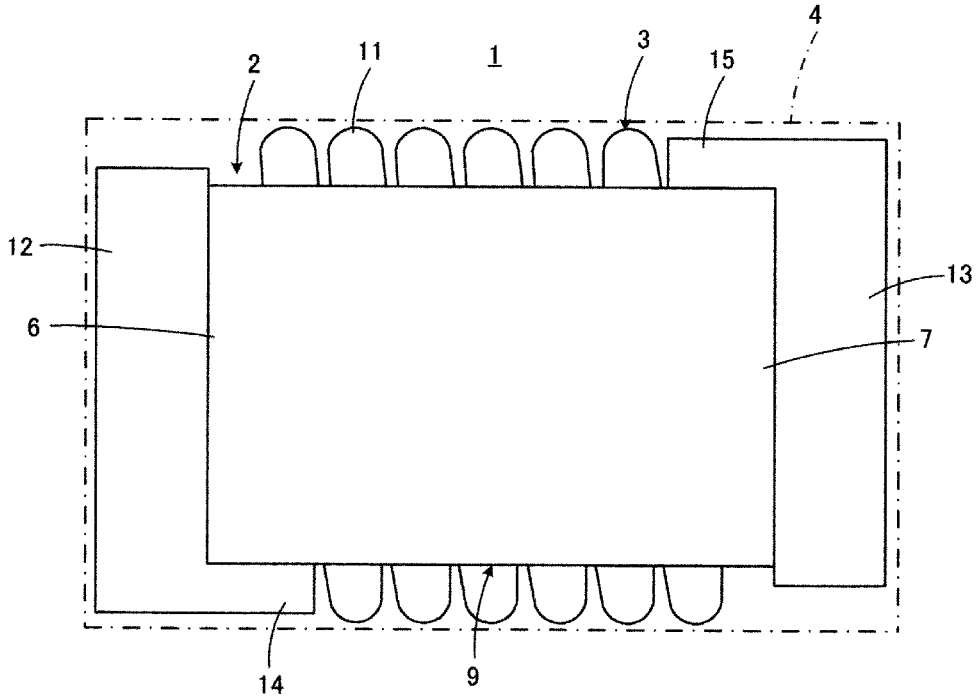
FIG. 3 is a bottom view of the coil component 1 illustrated in FIG. 1.
Figure 4:
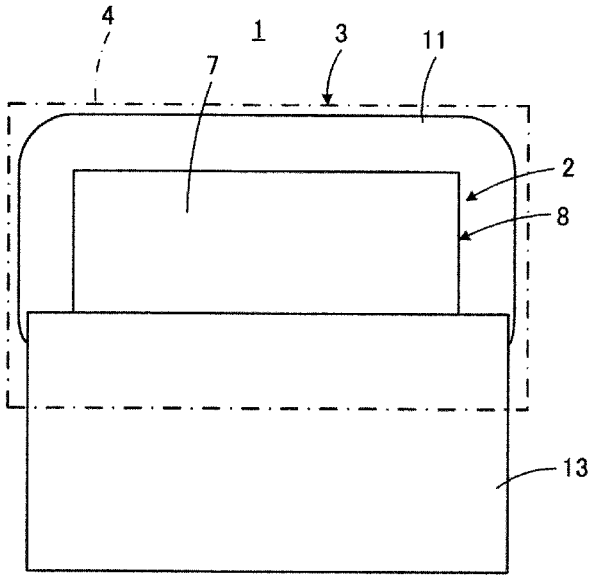
FIG. 4 is a right side view of the coil component 1 illustrated in FIG. 1.
Figure 12:
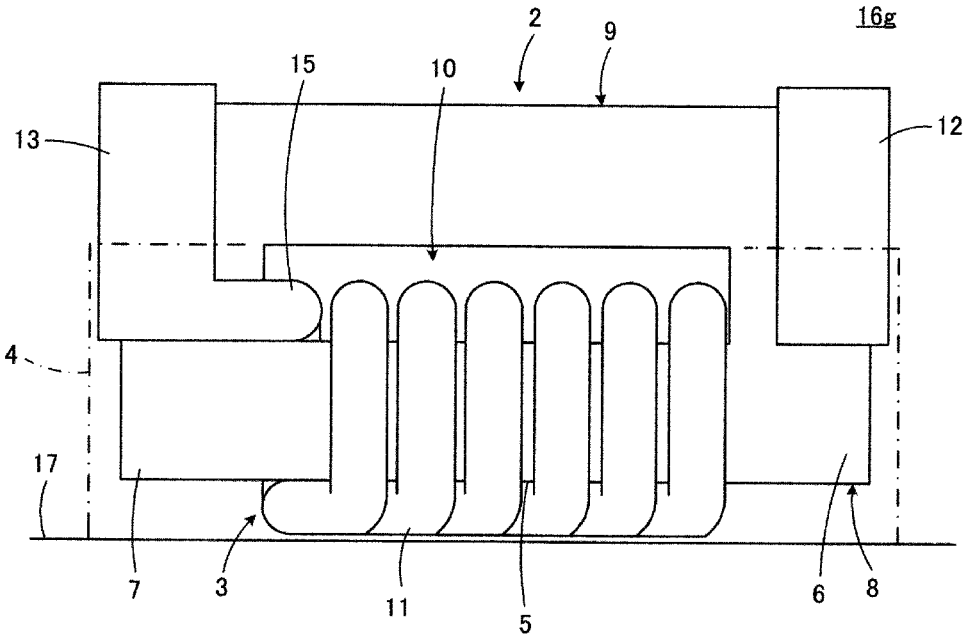
FIG. 12 is a front view illustrating a shaped object 16*g* obtained by further continuing the three-dimensional shaping from the state illustrated in FIG. 11 and completing the shaping.

FIG. 12 illustrates a shaped object 16*g* in which the coil component 1 illustrated in FIG. 2 is turned upside down. By sequentially carrying out steps described below, the shaped object 16*g* illustrated in FIG. 12 is obtained.

Figure 5:
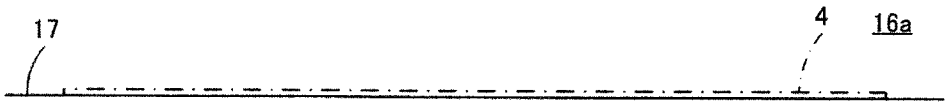
FIG. 5 is a view for illustrating a manufacturing method for the coil component 1 illustrated in FIG. 1, and is a front view illustrating a shaped object 16*a* immediately after three-dimensional shaping is started by using a 3D printer.

First, as illustrated in FIG. 5, a shaping table 17 is prepared, and three-dimensional shaping using a 3D printer is started on the shaping table 17. Shortly after the start of the three-dimensional shaping, a shaped object 16*a* to be part of the shape holding member 4 is obtained on the shaping table 17.

Thereafter, the three-dimensional shaping is continued. Then, in accordance with the lapse of time in which the three-dimensional shaping continues, shaped objects 16*b*, 16*c*, 16*d*, 16*e*, 16*f*, and 16*g* are sequentially generated illustrated in FIG. 6, FIG. 7, FIG. 9, FIG. 10, FIG. 11, and FIG. 12, respectively.

Figure 6:
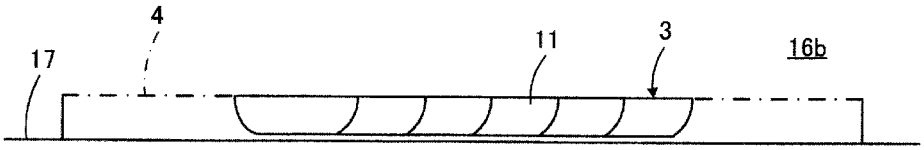
FIG. 6 is a front view illustrating a shaped object 16*b* obtained by continuing the three-dimensional shaping from the state illustrated in FIG. 5.

In FIG. 6, the shaped object 16*b* in which the height of a portion to be the shape holding member 4 is increased and which has a portion to be part of the spiral conductive wire 11 in the coil conductor 3 is generated.

Figure 7:
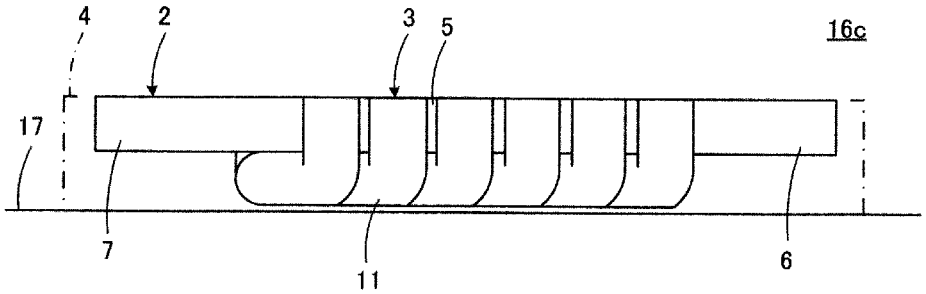
FIG. 7 is a front view illustrating a shaped object 16*c* obtained by further continuing the three-dimensional shaping from the state illustrated in FIG. 6.

Next, in FIG. 7, the shaped object 16*c* in which the height of a portion to be each of the shape holding member 4 and the spiral conductive wire 11 is increased and which has portions to be part of the winding core portion 5 in the core 2 and part of each of the first and second flange portions 6 and 7 is generated.

Here, referring to FIG. 8 which illustrates part of the shaped object 16*c* by a cross-sectional view in an enlarged manner, it can be seen that the spiral conductive wire 11 is circular in cross section and is in contact with the winding core portion 5 while being embedded in the shape holding member 4. Furthermore, FIG. 8 clearly illustrates that a predetermined interval is provided between adjacent turns of the spiral conductive wire 11 and these interval portions are filled with the shape holding member 4. Note that depending on the resolution of the 3D printer to be used, the cross-sectional shape of the spiral conductive wire 11 may not draw a clean circle outline as illustrated in FIG. 8, and may have a jagged outline.

Figure 9:
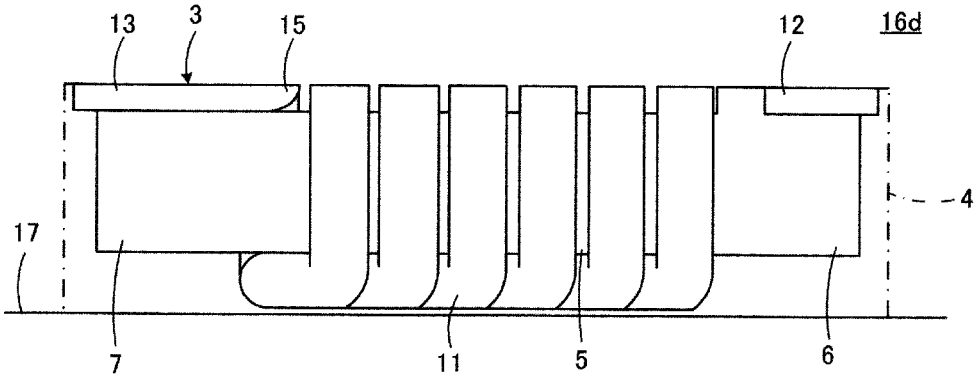
FIG. 9 is a front view illustrating a shaped object 16*d* obtained by further continuing the three-dimensional shaping from the state illustrated in FIG. 7.

Next, in FIG. 9, the shaped object 16*d* in which the height of a portion to be part of each of the shape holding member 4, the spiral conductive wire 11, and the first and second flange portions 6 and 7 is further increased and which has portions to be part of each of the first and second terminal electrodes 12 and 13 in the coil conductor 3 is generated. In the shaped object 16*d*, shaping of the winding core portion 5 is completed. Furthermore, the first and second terminal electrodes 12 and 13 are shaped together with the first and second flange portions 6 and 7, respectively, and are thus integrated with the first and second flange portions 6 and 7, respectively.

Figure 10:
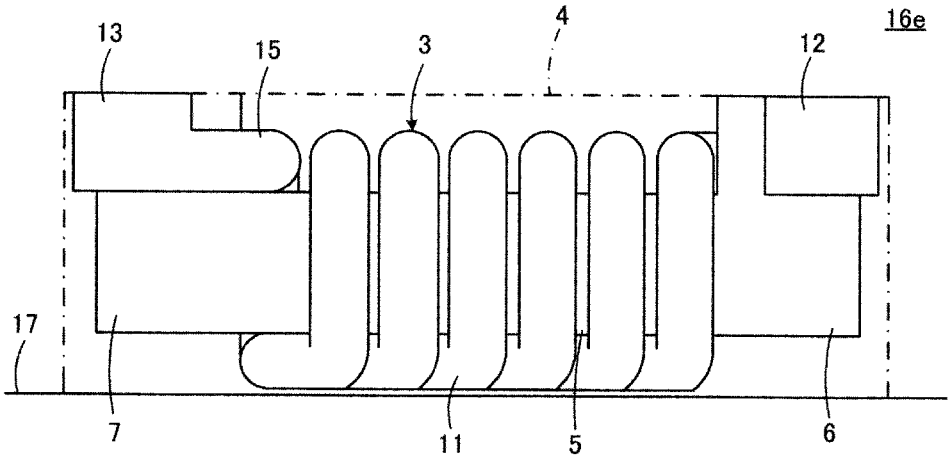
FIG. 10 is a front view illustrating a shaped object 16*e* obtained by further continuing the three-dimensional shaping from the state illustrated in FIG. 9.

Next, in FIG. 10, the shaped object 16*e* in which the height of a portion to be part of each of the first and second flange portions 6 and 7 and the first and second terminal electrodes 12 and 13 is further increased is obtained. In the shaped object 16*e*, shaping of the shape holding member 4 and the spiral conductive wire 11 is completed.

Figure 11:
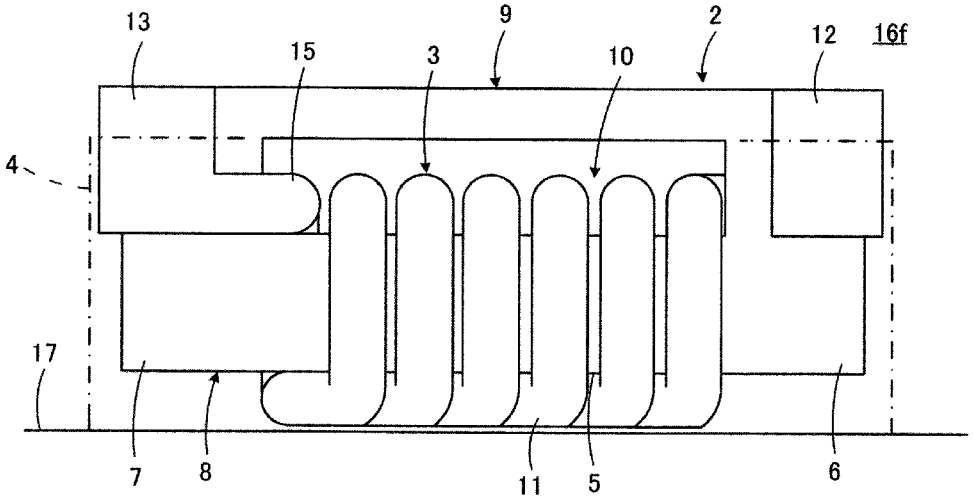
FIG. 11 is a front view illustrating a shaped object 16*f* obtained by further continuing the three-dimensional shaping from the state illustrated in FIG. 10.

Next, in FIG. 11, the shaped object 16*f* in which the height of a portion to be part of each of the first and second flange portions 6 and 7 and the first and second terminal electrodes 12 and 13 is further increased and in which shaping of the plate-shaped portion 9 in the core 2 is started is generated. Here, it should be noted that although the through-hole 10 is formed between the winding core portion 5 and the plate-shaped portion 9, filling the through-hole 10 with the shape holding member 4 makes it possible to shape the plate-shaped portion 9 by the 3D printer.

Next, in FIG. 12, the shaping of the first and second flange portions 6 and 7, the first and second terminal electrodes 12 and 13, and the plate-shaped portion 9 is completed, and the shaped object 16*g* including all of the elements provided in the coil component 1 illustrated in FIG. 2 is generated.

As described above, the three-dimensional shaping by the 3D printer is completed.

In the three-dimensional shaping step described above, it is preferable to use an ink-jet discharge type 3D printer as a 3D printer. In an ink-jet discharge type 3D printer, the core 2 is shaped with a non-conductive material powder containing solution, the coil conductor 3 is shaped with a conductive metal powder containing solution, and the shape holding member 4 is shaped with an electrically insulating material powder containing solution. Then, the core 2, the coil conductor 3, and the shape holding member 4 shaped by the ink-jet discharge type 3D printer are further fired. With this, the coil component 1 is completed.

In the shaping step described above, more specifically, a magnetic powder containing solution, more preferably, a ferrite powder containing solution or metal magnetic powder containing solution is used as the non-conductive material powder containing solution, a copper powder containing solution or a silver powder containing solution is used as the conductive metal powder containing solution, and a glass powder containing solution with a low dielectric constant, an alumina powder containing solution, or a zirconia powder containing solution is used as the electrically insulating material powder containing solution. When the copper powder containing solution is used as the conductive metal powder containing solution, it is preferable that the above-described firing step be performed under a reducing atmosphere.

Note that the step of firing the core 2, the coil conductor 3, and the shape holding member 4 is usually performed after completing the shaping of the core 2, the coil conductor 3, and the shape holding member 4, but by applying firing with a laser beam instead, for example, the firing may be performed simultaneously with the shaping of the core 2, the coil conductor 3, and the shape holding member 4. This latter firing method is particularly suitable when the copper powder containing solution is used as the conductive metal powder containing solution.

In the embodiment described above, the coil component 1 as a product includes the shape holding member 4, but the shape holding member 4 may not be present in the coil component as a product.

In other words, in the step of three-dimensionally shaping, the core 2 is shaped with a non-conductive material powder containing solution, and the coil conductor 3 is shaped with a conductive metal powder containing solution, but the shape holding member 4 is shaped with a resin containing solution. Then, although the core 2, the coil conductor 3, and the shape holding member 4 shaped by the 3D printer are fired, the shape holding member 4 is burned off in this firing step, and can thus be prevented from remaining in the coil component as a product.

According to the three-dimensional shaping using the 3D printer described above, it is possible to perform design change of the coil component as a product with ease, only by changing a program, as described below.

For example, in the illustrated embodiment, the spiral conductive wire 11 is wound in a single layer, but the spiral conductive wire may be subjected to multilayer winding including two or more layers. Additionally, in the multilayer winding, there may be only one or a plurality of spiral conductive wires. Accordingly, the coil component may be a component configuring a common mode choke coil, a transformer, or the like in addition to a component configuring a single coil. Furthermore, the spiral conductive wire 11 may also be wound around the plate-shaped portion 9 side.

Furthermore, in the illustrated embodiment, the coil component 1 includes two terminal electrodes 12 and 13, but may be a component which includes four terminal electrodes, which includes six terminal electrodes, or in which terminal electrodes are asymmetrically arranged. Furthermore, the shape, size, and arrangement of the terminal electrodes can also be freely changed.

Furthermore, the shape of the core can also be freely changed. For example, it is also easy to form the winding core portion in a conical shape.

Furthermore, the dimension of the coil component or the dimension of each element included in the coil component can also be freely changed.

Furthermore, a large number of coil components can be simultaneously shaped. In this case, the coil components which are simultaneously shaped may be of the same type or of different types.

Figure 13A:
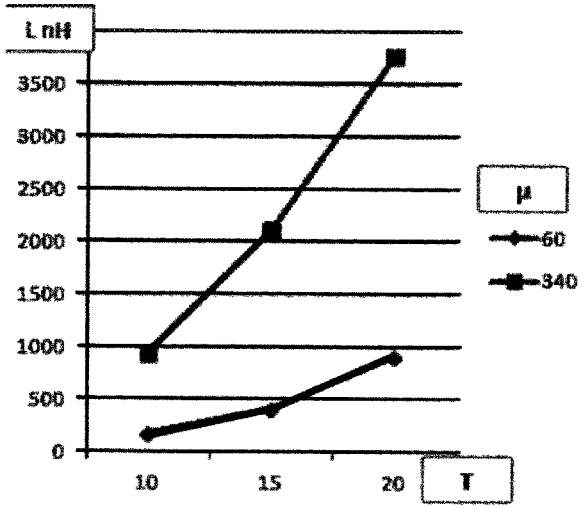
FIG. 13A shows inductance characteristics of a coil component according to a working example of the present disclosure.
Figure 13B:
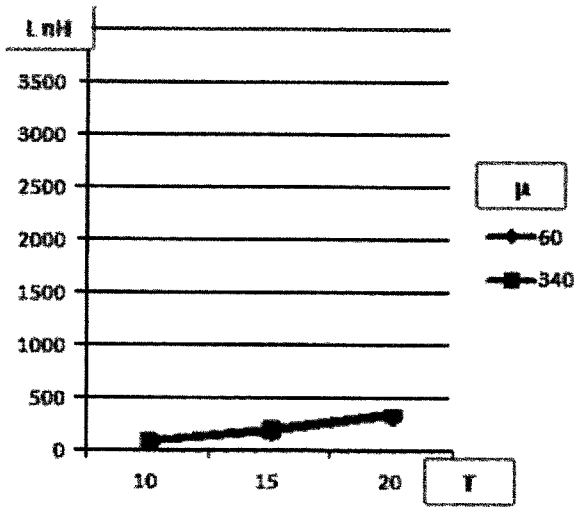
FIG. 13B shows inductance characteristics of a coil component according to a comparative example that is out of the scope of the present disclosure.

In FIGS. 13A and 13B, inductance characteristics of a coil component according to a working example of the present disclosure and a coil component according to a comparative example that is out of the scope of the present disclosure are compared. That is, FIG. 13A shows inductance characteristics of the coil component according to the working example, and FIG. 13B shows inductance characteristics of the coil component according to the comparative example.

The coil component according to the working example and the coil component according to the comparative example each were shaped so as to have a planar dimension of 0.4 mm×0.2 mm. Furthermore, the coil component according to the working example had the same structure as that of the coil component 1 illustrated in FIG. 1 to FIG. 4, and the coil component according to the comparative example was shaped so as to have an open magnetic path structure without the plate-shaped portion 9, and so as to have the same cross-sectional area of the winding core portion and the same magnetic path length as those of the coil component according to the working example.

In FIGS. 13A and 13B, the horizontal axis represents the number of turns of the spiral conductive wire on the winding core portion, and the vertical axis represents an inductance value. Additionally, the inductance values in two cases where the magnetic permeability of the core is 60 and is 340 are shown.

First, in the comparative example shown in FIG. 13B, the inductance values were approximately the same in both the cases where the magnetic permeability of the core was 60 and was 340, and the inductance value was less than 500 nH even if the number of turns of the conductive wire was increased up to 20.

On the other hand, in the working example shown in FIG. 13A, in the case where the magnetic permeability of the core was 60, when the number of turns of the conductive wire was 20, the inductance value exceeded 500 nH and increased to nearly 1000 nH. Furthermore, when the magnetic permeability of the core was 340, the inductance value reached nearly 1000 nH even when the number of turns of the conductive wire was 10, the inductance value increased as the number of turns increased to 15 and to 20, and when the number of turns was 20, the inductance value exceeding 3500 nH was obtained.

Although several different embodiments have been described above, in practicing the present disclosure, a partial replacement or combination of configurations is also possible among different embodiments.

What is claimed is:

1. A coil component comprising:

a core with an integrated structure, at least part of which is a winding core portion, which has an annular shape having a through-hole, and which is made of a non-conductive material; and a coil conductor with an integrated structure, which has a spiral conductive wire arranged so as to spirally extend around the winding core portion and first and second terminal electrodes formed at both end portions of the spiral conductive wire, respectively, wherein the core includes, in addition to the winding core portion, a drum-shaped portion having first and second flange portions respectively provided at a first end and a second end of the winding core portion located on opposite sides to each other, and a plate-shaped portion formed integrally with the drum-shaped portion and spanning between the first and second flange portions in a state of facing the winding core portion while forming the through-hole, and the spiral conductive wire is integrated with the winding core portion, and the first and second terminal electrodes are integrated with the first and second flange portions, respectively.

2. The coil component according to claim 1, wherein the core is made of a magnetic body, and forms a completely closed magnetic path.

3. The coil component according to claim 2, wherein the spiral conductive wire is circular in cross section.

4. The coil component according to claim 2, wherein each of the first and second terminal electrodes has a shape with which the first and second terminal electrodes each cannot pass through the through-hole of the core.

5. The coil component according to claim 1, further comprising:

a shape holding member made of an electrically insulating material, with which at least a space between the winding core portion and the plate-shaped portion is filled, wherein a portion of the spiral conductive wire located at least between the winding core portion and the plate-shaped portion is embedded in the shape holding member.

6. The coil component according to claim 5, wherein the shape holding member is made of glass.

7. The coil component according to claim 6, wherein the shape holding member is provided so as to cover the spiral conductive wire and the winding core portion, and part of each of the first and second terminal electrodes.

8. The coil component according to claim 5, wherein the shape holding member is provided so as to cover the spiral conductive wire and the winding core portion, and part of each of the first and second terminal electrodes.

9. The coil component according to claim 5, wherein the spiral conductive wire is circular in cross section.

10. The coil component according to claim 1, wherein the spiral conductive wire is circular in cross section.

11. The coil component according to claim 1, wherein each of the first and second terminal electrodes has a shape with which the first and second terminal electrodes each cannot pass through the through-hole of the core.

12. A manufacturing method for the coil component according to claim 1, the manufacturing method for the coil component comprising:

three-dimensionally shaping the core, the coil conductor, and a shape holding member for holding a shape of a wall surface of the core defining the through-hole, by using a 3D printer.

13. The manufacturing method for the coil component according to claim 12, wherein in the three-dimensionally shaping, an ink-jet discharge type 3D printer is used as the 3D printer, and shaping the core with a non-conductive material powder containing solution, shaping the coil conductor with a conductive metal powder containing solution, and shaping the shape holding member with an electrically insulating material powder containing solution, are performed, and the manufacturing method further comprises:

firing the core, the coil conductor, and the shape holding member shaped by the 3D printer.

14. The manufacturing method for the coil component according to claim 13, wherein a magnetic powder containing solution is used as the non-conductive material powder containing solution, and a copper powder containing solution or a silver powder containing solution is used as the conductive metal powder containing solution, and a glass powder containing solution, an alumina powder containing solution, or a zirconia powder containing solution is used as the electrically insulating material powder containing solution.

15. The manufacturing method for the coil component according to claim 12, wherein in the three-dimensionally shaping, an ink-jet discharge type 3D printer is used as the 3D printer, and shaping the core with a non-conductive material powder containing solution, shaping the coil conductor with a conductive metal powder containing solution, and shaping the shape holding member with a resin containing solution, are performed, and the manufacturing method further comprises:

firing the core, the coil conductor, and the shape holding member shaped by the 3D printer, wherein the firing includes burning off the shape holding member.

16. The manufacturing method for the coil component according to claim 15, wherein a magnetic powder containing solution is used as the non-conductive material powder containing solution, and a copper powder containing solution or a silver powder containing solution is used as the conductive metal powder containing solution, and a glass powder containing solution, an alumina powder containing solution, or a zirconia powder containing solution is used as the electrically insulating material powder containing solution.

* * * * *